US005293922A

United States Patent [19]

Imai et al.

[11] Patent Number: 5,293,922

[45] Date of Patent: Mar. 15, 1994

[54] PROCESS FOR MANUFACTURING GAS FLOW UNIT

[75] Inventors: Kiwamu Imai, Tanashi; Masami Sayama, Tokorozawa; Kazuyuki Higashino, Iruma; Kazuo Sano, Higashiyamato; Yasunori Omori, Ome; Hoshiro Tani, Kitakyushu; Yukinori Matsushima, Yukuhashi, all of Japan

[73] Assignees: Ishikawajima-Harima Jukogyo Kabushiki Kaisha, Tokyo; Mishima Kosan Kabushiki Kaisha, Fukuoka, both of Japan

[21] Appl. No.: 979,787

[22] Filed: Nov. 20, 1992

[30] Foreign Application Priority Data

Nov. 25, 1991 [JP] Japan ..... 3-335608

[51] Int. Cl.[5] ..... B22D 19/00

[52] U.S. Cl. ..... 164/46; 164/496; 164/98; 164/132

[58] Field of Search ..... 164/46, 132, 98, 496

[56] References Cited

FOREIGN PATENT DOCUMENTS 49-18904 5/1974 Japan .
50-140718 11/1975 Japan .
56-47377 11/1981 Japan .
61-78263 5/1986 Japan .

*Primary Examiner*—Kuang Y. Lin
*Attorney, Agent, or Firm*—Oblon, Spivak, McClelland, Maier & Neustadt

[57] ABSTRACT

A metal is attached on a passage-forming core by electrocasting to provide a primary metal layer. A plurality of grooves are formed on the primary metal layer and are filled with filler of low melting point. A metal is attached on the primary metal layer by electrocasting to provide a secondary metal layer. Openings are formed on the secondary metal layer adjacent to its opposite ends so as to communicate with the grooves. The filler in the grooves is melted to provide a plurality of coolant passages. The openings are filled with manifold-forming cores made of filler with low melting point. A metal is attached on the manifold-forming cores by electrocasting to provide tertiary metal layers. Through holes are formed on the tertiary metal layers. The passage-forming core is dissolved and the manifold-forming cores are melted to provide a gas passage and manifolds.

1 Claim, 7 Drawing Sheets

PROCESS FOR MANUFACTURING GAS FLOW UNIT

BACKGROUND OF THE INVENTION

The present invention relates to a process for manufacturing a gas flow unit.

A hollow gas flow unit such as rocket nozzle for allowing high-temperature gas to flow through is designed to have means for cooling the unit itself.

Referring to FIG. 1, a conventional hollow gas flow unit will be briefly explained which is a heat exchanger or rocket nozzle as disclosed in Japanese Utility Model 1st Publication No. 61-78263.

An inner cylinder 1 with a gas passage 2 comprises two concentrically laminated, substantially cylindrical electrocast copper layers 3 and 4 with coolant passages 6 being defined by the layer 4 and grooves 5 on the layer 3.

A two-split type outer cylinder 7 made of a heat-resistant alloy is fitted over and joined to the inner cylinder 1 by welding or the like. The outer cylinder 7 has, at its opposite ends, manifolds 8 and 9 which are in communication with the passages 6.

When high-temperature gas is to flow through the passage 2 in the above-mentioned heat exchanger, coolant is introduced through one manifold 8 into the passages 6 to cool the inner cylinder 1. The coolant with increased temperature due to cooling of the cylinder 1 is discharged out of the passages 6 through the other manifold 9 so that any temperature rise in the cylinder 1 is suppressed.

In the above-mentioned heat exchanger, the cylinders 1 and 7 are joined together by welding or the like only at their opposite ends so that the outer cylinder 7 must be designed to have a thicker wall capable of enduring any pressure of the coolant flowing through the passages 6 as well as most of the pressure of the gas flowing through the passage 2, resulting in increase of weight of the heat exchanger as a whole.

Because of the cylinders 1 and 7 being joined together by welding or the like, the layers 3 and 4 may separate from each other due to any local heat, resulting in leakage of the coolant.

The present invention was made in due consideration to the above-mentioned problems and has its object to provide a process for manufacturing a gas flow unit which contributes to reduction in weight of a gas flow unit, prevents separation of electrocast layers and excludes leakage of the coolant.

BRIEF SUMMARY OF THE INVENTION

In order to attain the object, the present invention provides a process for manufacturing a gas flow unit comprising the steps of providing a passage-forming core made of metal with low melting point, attaching a metal on the passage-forming core by electrocasting to provide a primary metal layer, forming a plurality of longitudinally extending grooves on said primary metal layer, filling said grooves with low-melting-point filler, attaching a metal on said primary metal layer by electrocasting to provide a secondary metal layer, circumferentially machining said secondary metal layer adjacent to opposite ends thereof to provide openings communicating with said grooves, heating said filler to melt the same, discharging the melted filler out of the secondary metal layer through said openings to provide a plurality of coolant passages defined by said grooves and said secondary metal layer, filling each of said openings with a manifold-forming core made of low-melting-point filler, attaching a metal on said manifold-forming cores and on said secondary metal layer adjacent to said manifold-forming cores by electrocasting to provide tertiary metal layers, forming a through hole on each of said tertiary metal layers so as to lead from outside to the corresponding manifold-forming core, dissolving said passage-forming core, discharging the dissolved passage-forming core out of the primary metal layer to provide a gas passage inside the primary metal layer, heating the manifold-forming cores to melt the same, discharging the melted manifold-forming cores out of the tertiary metal layers through said through holes to provide coolant manifolds defined by said openings and said tertiary metal layers.

According to the present invention, a gas flow unit comprising a gas passage, coolant passages, manifolds and flanges is integrally manufactured through formation of primary, secondary and tertiary metal layers by electrocasting so that it can be lightweight.

Because of the whole gas flow unit including manifolds and flanges being integrally manufactured by electrocasting, there is no need of joining manifolds and flanges by welding. As the result, no separation of metal layers due to thermal effects as well as no leakage of coolant will occur.

DETAILED DESCRIPTION OF THE PREFERRED EMBODIMENT

Figure 1:
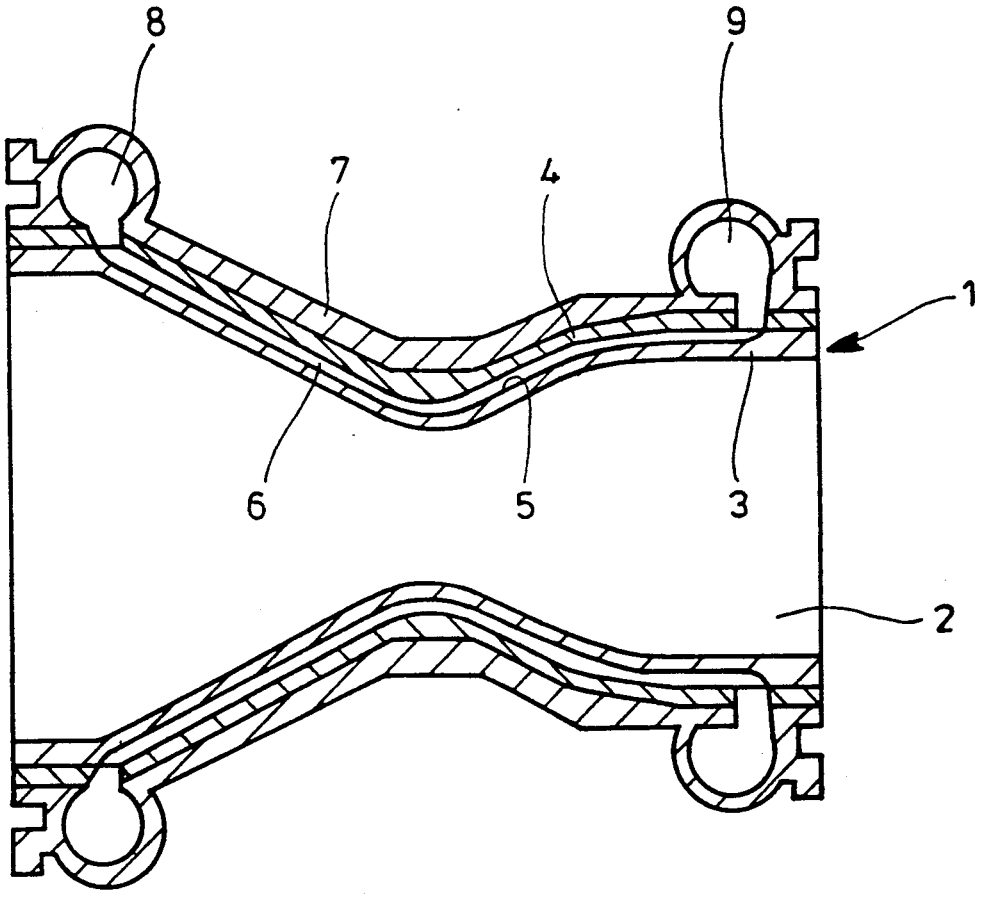
Fig. 1 PRIOR ART
FIG. 1 is a sectional view of a conventional gas flow unit.
Figure 2:
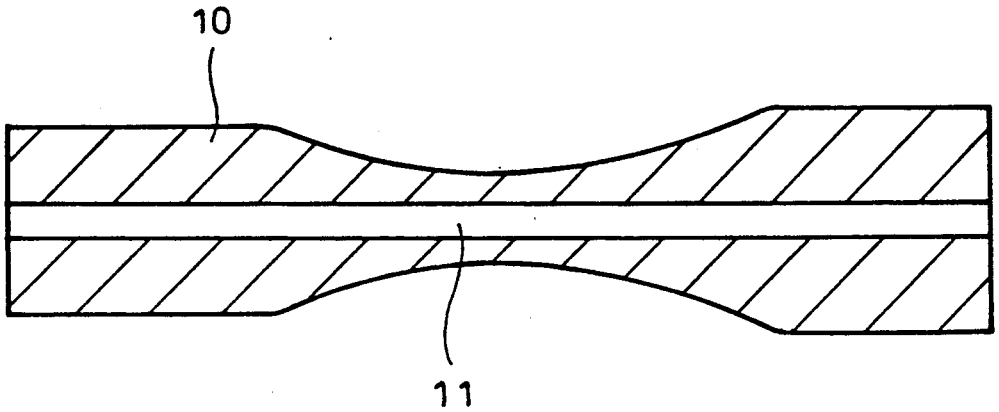
FIG. 2 is a sectional view of a passage-forming dissoluble core which is used in manufacturing a combustion vessel having a gas passage rectangular in cross-section according to the present invention.
Figure 3:
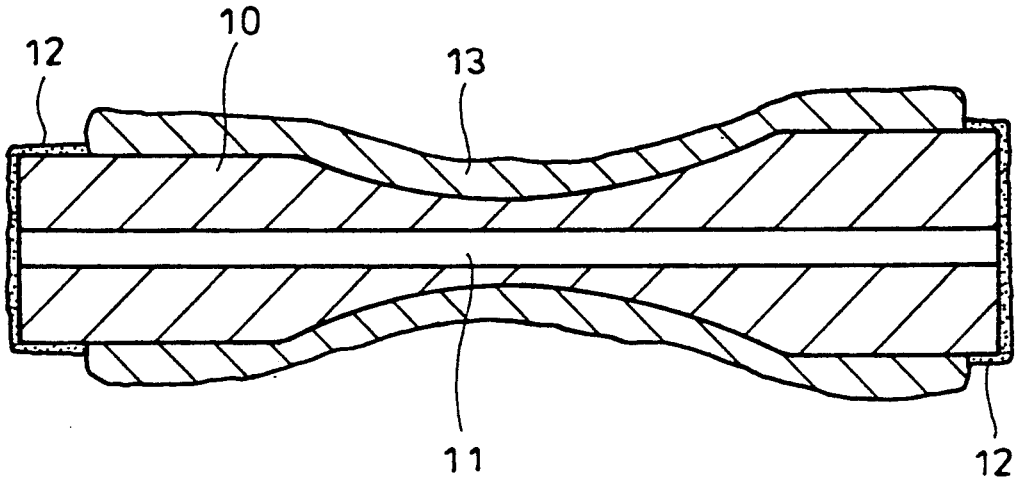
FIG. 3 is a sectional view of a primary metal layer formed by electrocasting on the passage-forming dissoluble core of FIG. 2.
Figure 4:
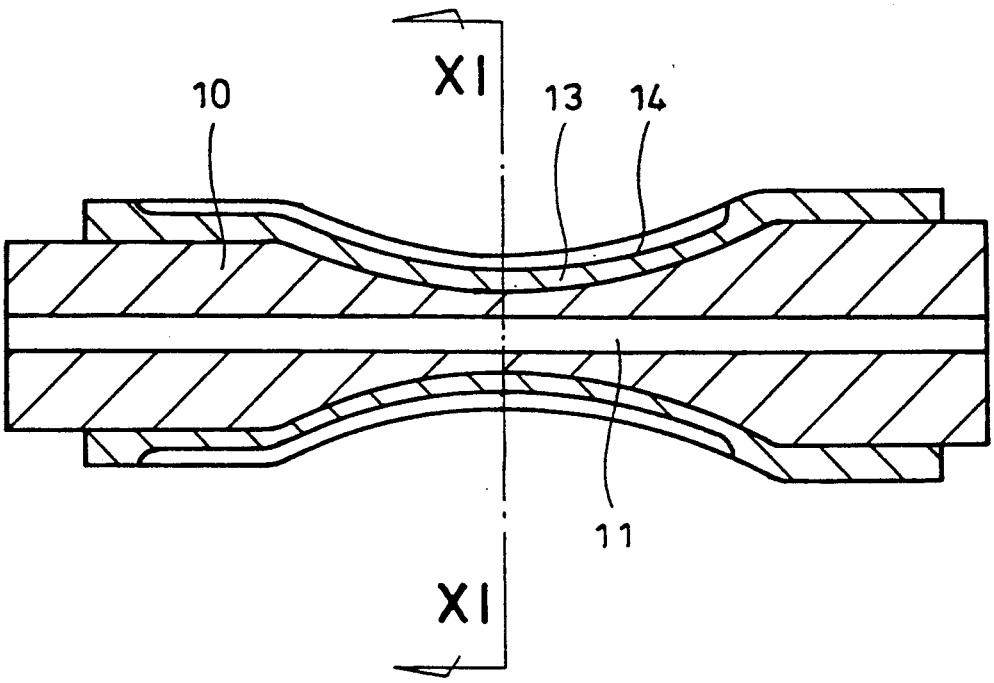
FIG. 4 is a sectional view showing the primary metal layer of FIG. 3 formed with grooves on its surface.
Figure 5:
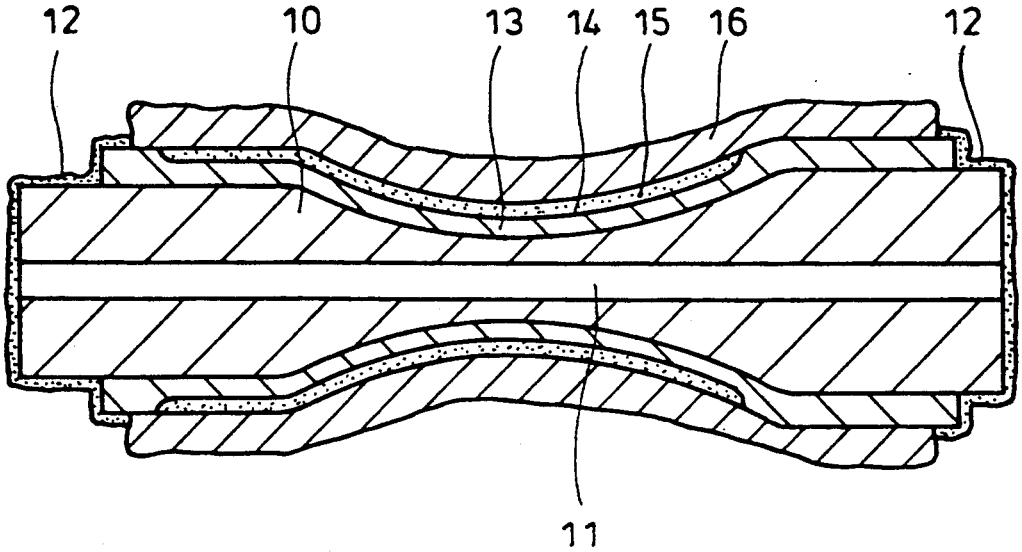
FIG. 5 is a sectional view of a secondary metal layer formed by electrocasting on the primary metal layer of FIG. 4.
Figure 6:
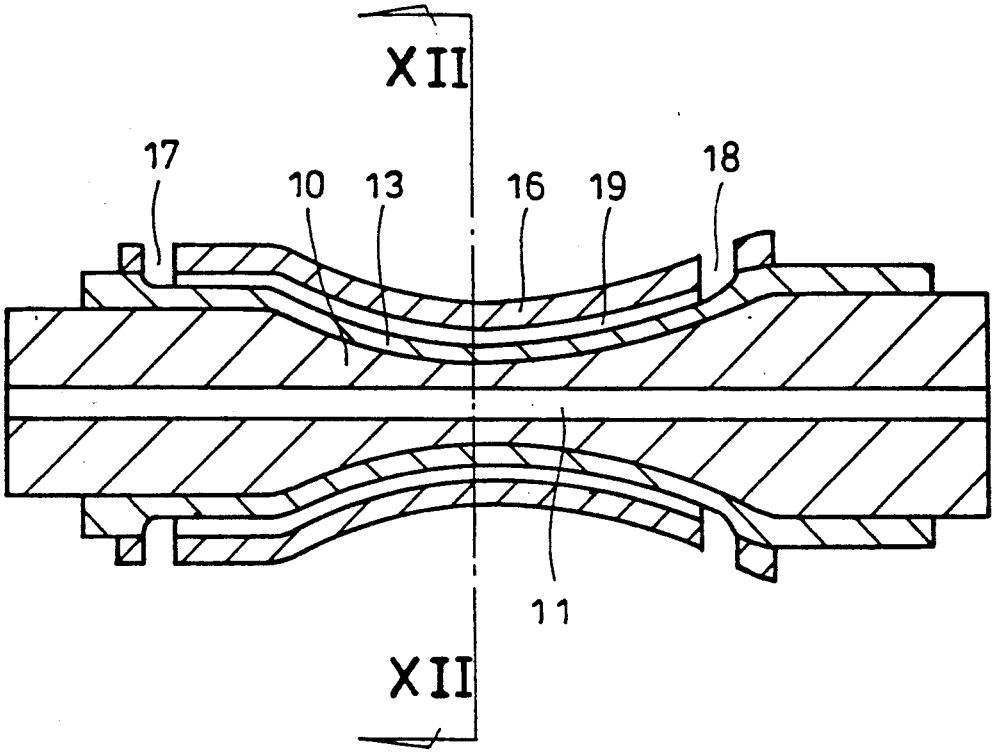
FIG. 6 is a sectional view showing the secondary metal layer of FIG. 5 formed with openings and coolant passages.
Figure 7:
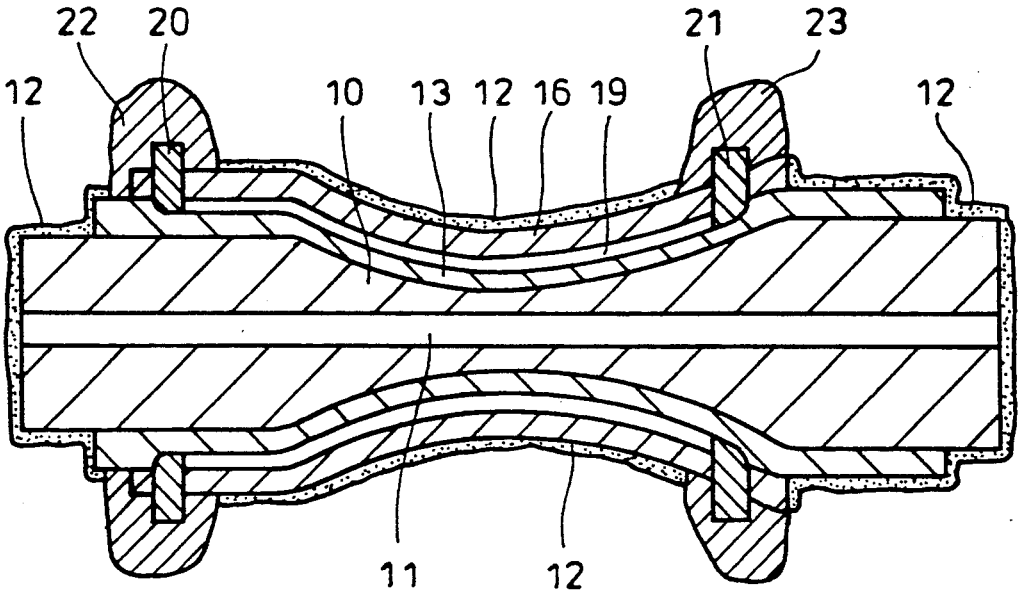
FIG. 7 is a sectional view of manifold-forming fusible cores fitted with the openings of FIG. 6 as well as tertiary metal layers formed by electrocasting on the manifold-forming fusible cores and on the secondary metal layer.
Figure 8:
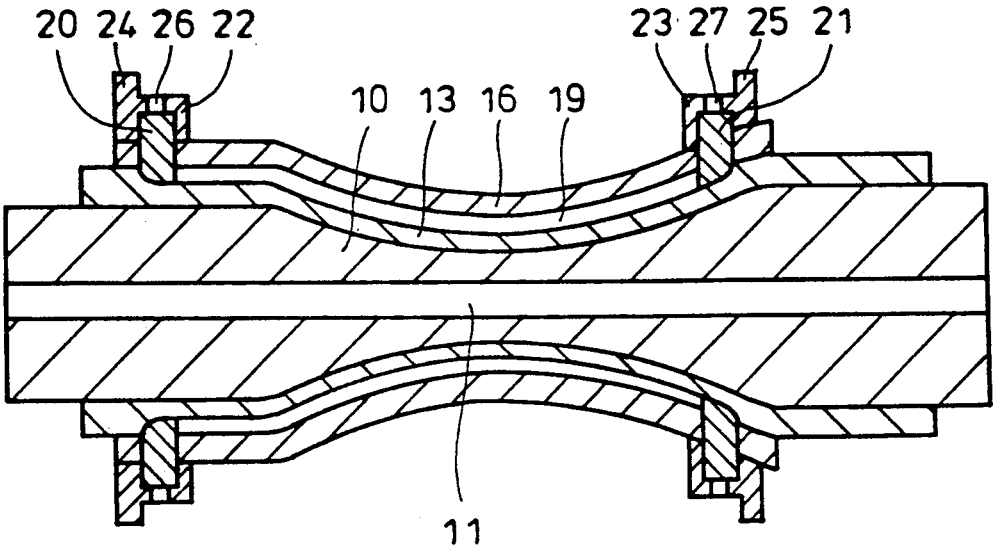
FIG. 8 is a sectional view showing the tertiary metal layers of FIG. 7 formed with through holes so as to lead from outside to the manifold-forming fusible cores.

A preferred embodiment of the present invention will be described in conjunction with the drawings.

FIG. 2 through FIG. 13 represent steps in manufacturing a combustion vessel having a gas passage rectangular in cross-section according to a process for manufacturing a gas flow unit of the present invention.

A passage-forming dissoluble core 10 having a longitudinal through hole or holes 11 for promotion of metal fusion is fabricated, using an aluminum alloy. The core 10 is rectangular in cross-section and is constricted at its longitudinally intermediate portion (See FIG. 2).

Pre-treatment such as grinding, polishing and/or degreasing is carried out on the core 10. Maskings 12 are fitted over opposite ends of the core 10. Then, the core 10 is placed in an electrocasting vessel so that a metal such as copper is attached on the core 10 by electrocasting to provide a primary metal layer 13 (See FIG. 3).

With the primary metal layer 13 being formed, the core 10 is taken out of the electrocasting vessel, the maskings 12 are removed therefrom and washing and heat treatments are carried out on the layer 13. After the surface of the layer 13 is smoothed by machining or the like, a plurality of grooves 14 extending longitudinally of the core 10 are formed on the layer 13 by electric discharge machining or the like (See FIGS. 4 and 11).

Then, pre-treatment such as grinding, polishing and/or decreasing is carried out on the layer 13 and maskings 12 are fitted over opposite ends of the core 10.

Each of the grooves 14 is filled with low-melting-point filler 15 such as wax. After a treatment is carried out on the surface of the filler 15 for its better electric conductivity, the core 10 is placed in the electrocasting vessel and a metal such as copper is attached on the layer 13 and filler 15 to provide a secondary metal layer 16 (See FIG. 5).

With the layer 16 being formed, the core 10 is taken out of the electrocasting vessel, the maskings 12 are removed therefrom and washing and heat treatments are carried out. The surface of the layer 16 is smoothed by machining or the like.

Further, the layer 16 is circumferentially machined at positions adjacent to its opposite ends to provide openings 17 and 18 which communicate with the respective grooves 14. The layer 16 is heated to melt the filler 15 and the melted filler 15 is discharged through the openings 17 and 18 out of the layer 16 to provide a plurality of coolant passages 19 defined by the grooves 14 and the layer 16 (See FIGS. 6 and 12)

Pre-treatment such as grinding, polishing and/or degreasing is performed on the layers 13 and 16. The openings 17 and 18 are filled with manifold-forming cores 20 and 21 made of low melting point filler and maskings 12 are fitted over opposite ends of the core 10 and layer 13 and over the layer 16 except for regions around the cores 20 and 21. Then, the core 10 is placed in the electrocasting vessel and a metal such as copper is attached by electrocasting on the cores 20 and 21 and on the surface of the layers 13 and 16 adjacent to the cores 20 and 21, thereby providing a tertiary metal layers 22 and 23 (See FIG. 7).

When the layers 22 and 23 being formed, the core 10 is taken out of the electrocasting vessel, the maskings 12 are removed therefrom and washing and heat treatments are carried out. The tertiary metal layers 22 and 23 are machined or the like to form flanges 24 and 25. Through holes 26 and 27 are formed on the layers 22 and 23 so as to lead from outside to the cores 20 and 21 (See FIG. 8).

Figure 9:
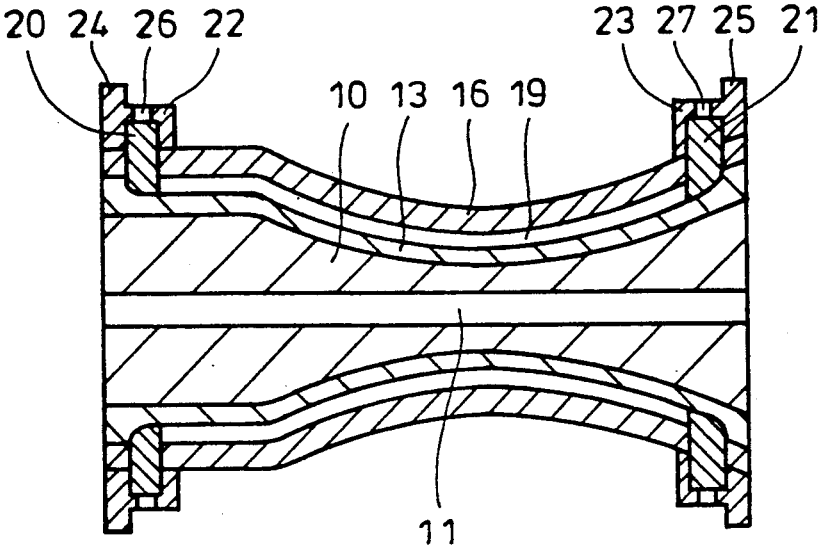
FIG. 9 is a sectional view showing the primary metal layer and passage-forming dissoluble core of FIG. 8 with their opposite ends being cut off.

Outward portions of the layer 13 beyond the flanges 24 and 25 are cut off by machining or the like (See FIG. 9).

The core 10 is dissolved by for example an aqueous solution of sodium hydroxide. The dissolved core 10 is discharged out of the layer 13 to provide a gas passage 30 inside the layer 13. The layers 22 and 23 are heated to melt the cores 20 and 21. The melted cores 20 and 21 are discharged out of the layers 22 and 23 through the holes 26 and 27 to provide coolant manifolds 28 and 29 defined by the openings 17 and 18 and the layers 22 and 23 (See FIGS. 10 and 13).

When high temperature gas is to pass through the passage 30 in a combustion vessel with the above-mentioned structure, coolant is introduced from the hole 26 through the manifold 28 into the passages 19 so that any temperature rise of the layers 13 and 16 due to passing of the high temperature gas is suppressed.

The coolant with increased temperature due to cooling of the layers 13 and 16 is passed through the passages 19 to the manifold 29 and is discharged through the hole 27 to outside.

Figure 10:
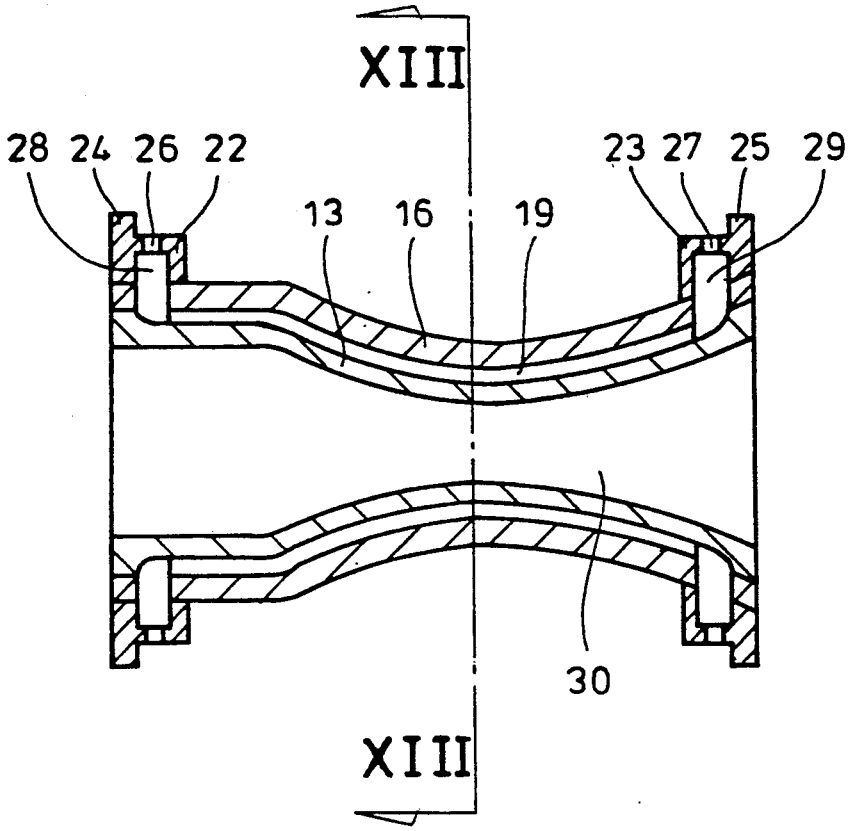
FIG. 10 is a sectional view showing the tertiary metal layers of FIG. 9 with coolant manifolds inside as well as the primary metal layer with a gas passage inside.
Figure 11:
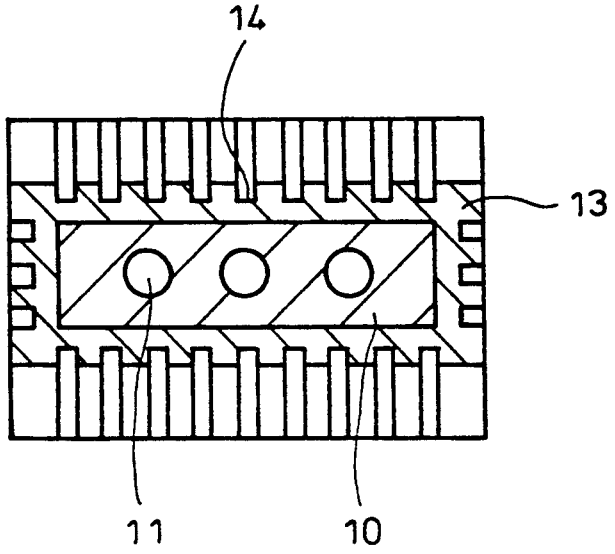
FIG. 11 is a sectional view taken along the line XI—XI of FIG. 4.
Figure 12:
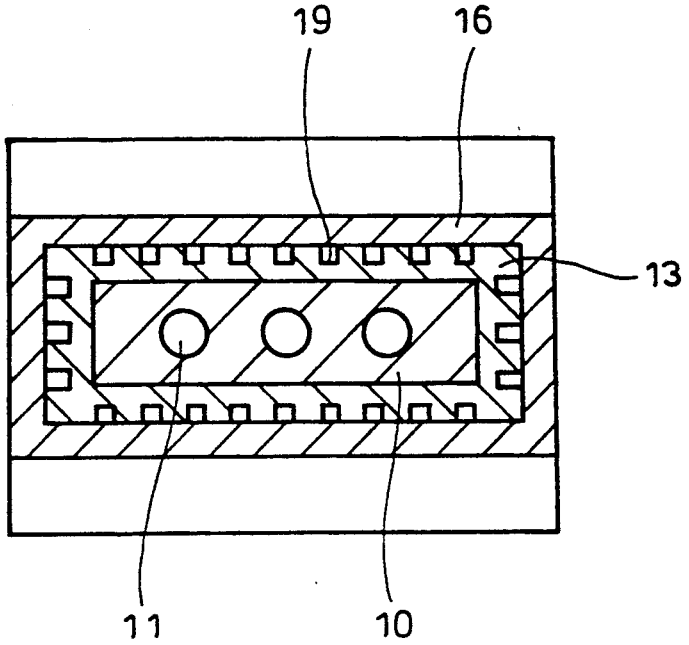
FIG. 12 is a sectional view taken along the line XII—XII of FIG. 6.
Figure 13:
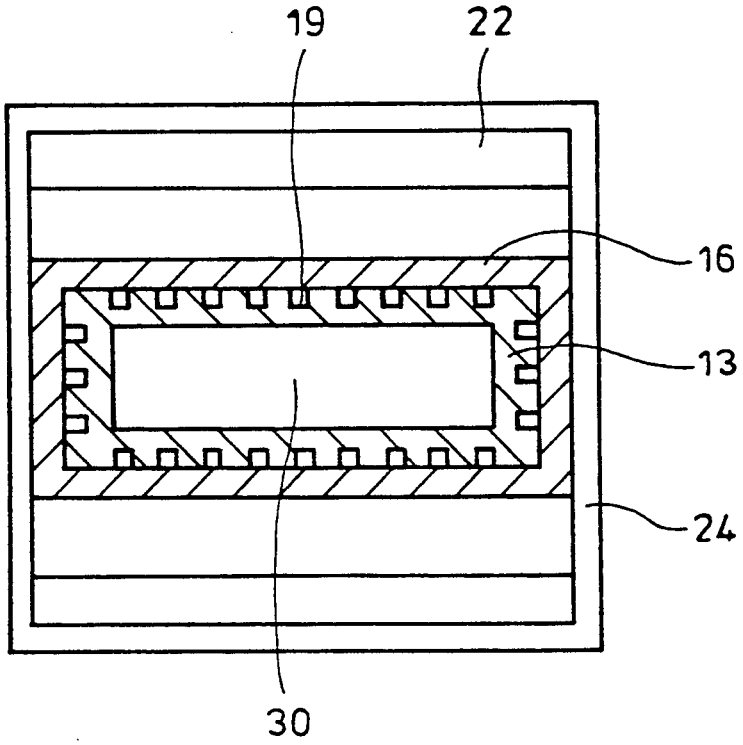
FIG. 13 is a sectional view taken along the line XIII—XIII of FIG. 10.

The combustion vessel of FIG. 10 having the gas passage 30, the coolant passages 19, the manifolds 28 and 29 and the flanges 24 and 25 is integrally manufactured through formation of the primary, secondary and tertiary metal layers 13, 16, 22 and 23 by electrocasting so that it can be lightweight in comparison with conventional combustion vessels.

Because of the whole combustion vessel including the manifolds 28 and 29 and the flanges 24 and 25 being integrally manufactured by electrocasting, there is no need of joining the manifolds 28 and 29 and the flanges 24 and 25 by welding. As the result, no separation of the metal layers 13 and 16 due to thermal effects as well as no leakage of the coolant will occur.

The shape of the gas passage 30 may be freely varied by changing the shape of the core 10 in manufacturing of a combustion vessel by the above procedure.

It is to be understood that a process for manufacturing a gas flow unit according to the present invention is not limited to the above-mentioned embodiment and that various changes and modifications may be made without departing from the true spirit of the present invention. For example, the primary, secondary and tertiary metal layers may be formed from metal other than copper by electrocasting or different metals may be used for each of the metal layers.

As is clear from the foregoing, the following effects, features and advantages are obtained by a process for manufacturing a gas flow unit according to the present invention:

(1) A gas flow unit having a gas passage, coolant passages, manifolds and flanges may be lightweight since it is integrally manufactured through formation of primary, secondary and tertiary metal layers by electrocasting.

(2) Because of the whole gas flow unit being integrally formed by electrocasting including coolant manifolds and flanges, there is no need of welding the manifolds and the flanges so that no separation of the metal layers due to thermal effects as well as no leakage of coolant will occur.

(3) The shape of the gas passage may be varied by changing the shape of a passage-forming core in manufacturing of a gas flow unit.

What is claimed is:

1. A process for manufacturing a gas flow unit comprising the steps of providing a passage-forming core made of metal with low melting point, attaching a metal on the passage-forming core by electrocasting to provide a primary metal layer, forming a plurality of longitudinally extending grooves on said primary metal layer, filling said grooves with low-melting-point filler, attaching a metal on said primary metal layer by electrocasting to provide a secondary metal layer, circumferentially machining said secondary metal layer adjacent to opposite ends thereof to provide openings communicating with said grooves, heating said filler to melt the same, discharging the melted filler out of the secondary metal layer through said openings to provide a plurality of coolant passages defined by said grooves and said secondary metal layer, filling each of said openings with a manifold-forming core made of low-melting-point filler, attaching a metal on said manifold-forming cores and on said secondary metal layer adjacent to said manifold-forming cores by electrocasting to provide tertiary metal layers, forming a through hole on each of said tertiary metal layers so as to lead from outside to the corresponding manifold-forming core, dissolving said passage-forming core, discharging the dissolved passage-forming core out of the primary metal layer to provide a gas passage inside the primary metal layer, heating the manifold-forming cores to melt the same, discharging the melted manifold-forming cores out of the tertiary metal layers through said through holes to provide coolant manifolds defined by said openings and said tertiary metal layers.

* * * * *